US007762937B2

(12) United States Patent
Younane et al.

(10) Patent No.: US 7,762,937 B2
(45) Date of Patent: Jul. 27, 2010

(54) EXERCISE APPARATUS

(75) Inventors: Paul Peter Maroon Younane, 3 The Mount, Hoggarth Close, Petersfield, Hampshire GU31 4YS (GB); Bronte Paul Eckermann, Eastwood (AU)

(73) Assignee: Paul Peter Maroon Younane, Hampshire (GB)

( * ) Notice: Subject to any disclaimer, the term of this patent is extended or adjusted under 35 U.S.C. 154(b) by 0 days.

(21) Appl. No.: 11/895,021

(22) Filed: Aug. 21, 2007

(65) Prior Publication Data

US 2008/0058183 A1 Mar. 6, 2008

Related U.S. Application Data

(63) Continuation of application No. PCT/GB2006/000603, filed on Feb. 21, 2006.

(30) Foreign Application Priority Data

Feb. 22, 2005 (GB) ..... 0503642.1

(51) Int. Cl.
*A63B 26/00* (2006.01)

(52) U.S. Cl. ..... 482/140; 482/121

(58) Field of Classification Search ..... 482/140, 482/142, 91, 907, 121–130, 908, 148
See application file for complete search history.

(56) References Cited

U.S. PATENT DOCUMENTS

| | | | | |
|---|---|---|---|---|
| 3,337,215 A | | 8/1967 | Melchiona | |
| 3,761,083 A | | 9/1973 | Buchner | |
| 4,865,317 A | | 9/1989 | Hickey | |
| 5,295,935 A | * | 3/1994 | Wang | 482/130 |
| 6,352,494 B2 | * | 3/2002 | McAlonan | 482/77 |
| 6,544,152 B2 | * | 4/2003 | Rosati | 482/126 |
| 7,217,228 B2 | * | 5/2007 | Marquez | 482/130 |
| 2002/0160891 A1 | * | 10/2002 | Gallagher | 482/123 |

FOREIGN PATENT DOCUMENTS

| | | | |
|---|---|---|---|
| DE | 2051786 | * | 3/1972 |
| DE | 2 051 786 | | 5/1972 |
| EP | 0 248 249 | | 12/1987 |
| EP | 0248249 | * | 12/1987 |
| EP | 0 829 277 | | 3/1998 |
| EP | 0829277 | * | 3/1998 |
| GB | 1 052 620 | | 12/1966 |
| GB | 1052620 | * | 12/1996 |
| GB | 2 405 108 | | 2/2005 |
| GB | 2405108 | * | 2/2005 |

* cited by examiner

*Primary Examiner*—Lori Baker
(74) *Attorney, Agent, or Firm*—Lawrence G. Fridman, Esq.

(57) ABSTRACT

A variable resistance device and an abdominal exercise apparatus. The device includes at least first and second resilient stages to provide a combined resistance effect. The first resilient stage has a lower coefficient of elasticity than the second resilient stage. In this way, when a user lies on the base of the apparatus and pulls on the yoke a first resistance is experienced by virtue of thin cords until a strap reaches its full length and a second resistance is experienced by virtue of thick cords.

9 Claims, 6 Drawing Sheets

FIG. 7
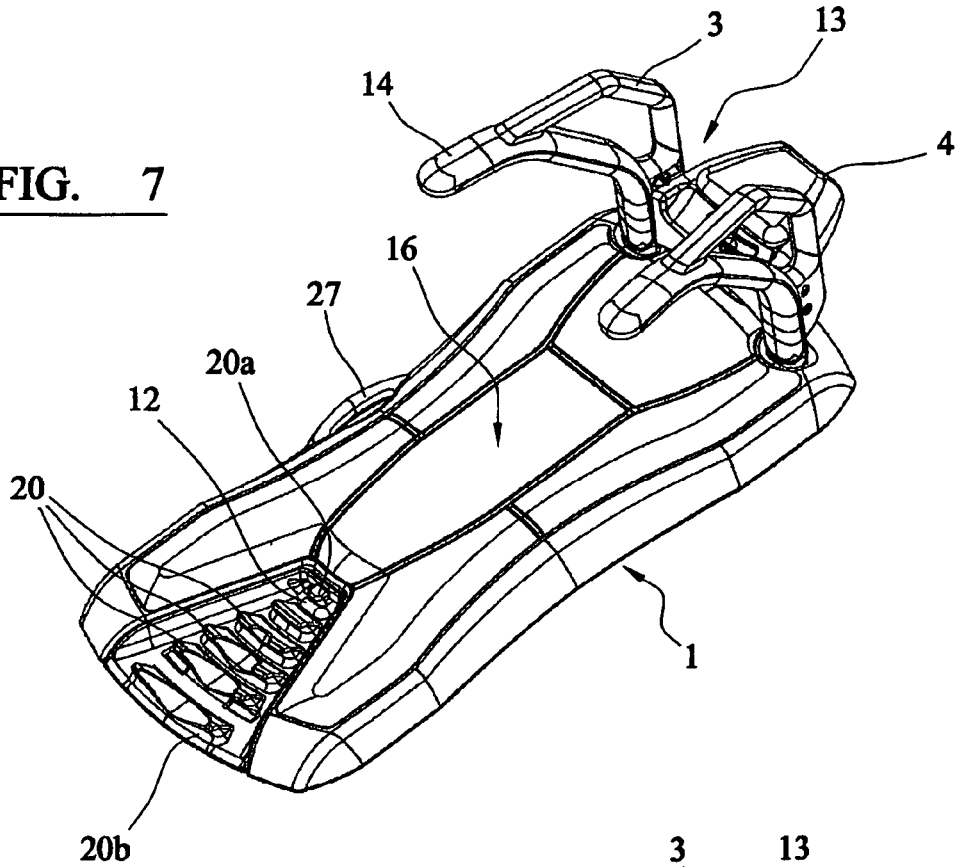
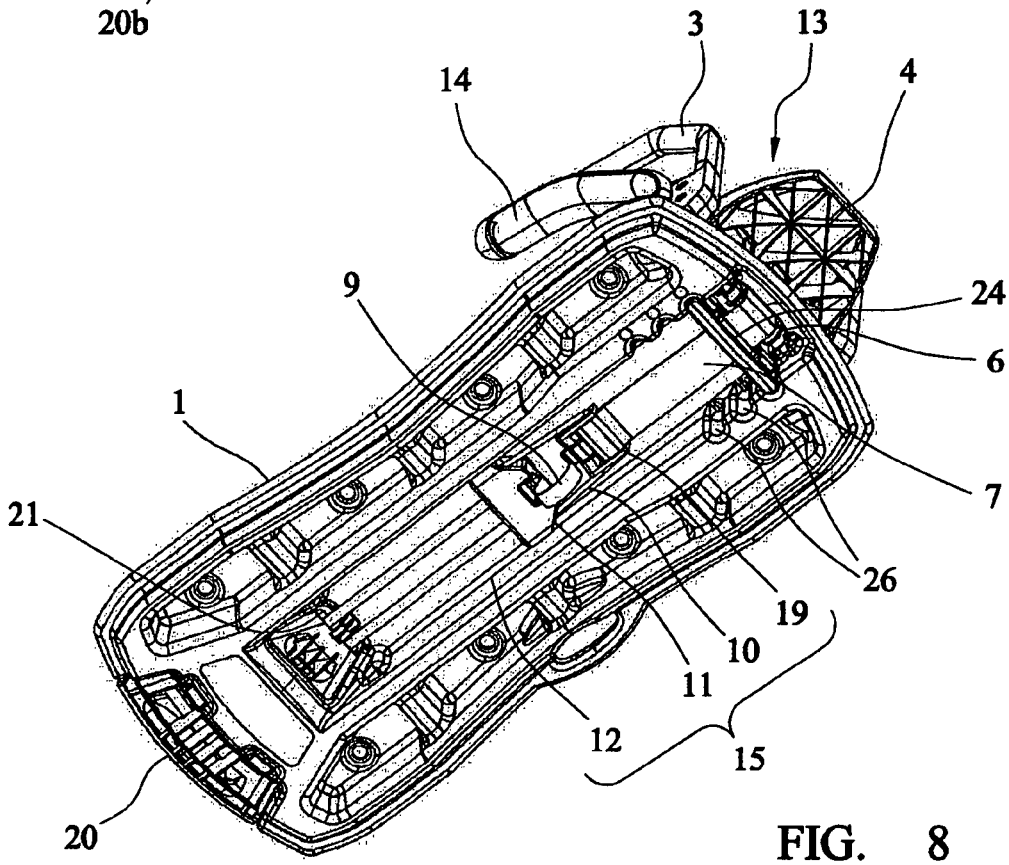
FIG. 8

EXERCISE APPARATUS

THIS IS A CONTINUING APPLICATION OF PCT APPLICATION PCT/GB2006/000603 FILED FEB. 21, 2006 WHICH CLAIMS PRIORITY OF GREAT BRITAIN PATENT APPLICATION GB 0503642.1 FILED FEB. 22, 2005

FIELD OF THE INVENTION

The present invention relates in general to an exercise apparatus, particularly for strengthening the abdominal muscles (rectus abdominus and obliques). The invention also relates to variable resistance device for such an apparatus.

BACKGROUND OF INVENTION

Many abdominal exercise apparatus/machines are known, the majority of which are confined to the "sit-up" or "crunch" movement where an individual, lying on one's back, flexes the trunk against the combined loads of upper body weight and gravity. By increasing the number of repetitive sit-ups endurance is improved over time and the abdominal muscles can become toned (more defined). However, there are no strength gains other than for the specific load value provided by upper body weight and gravity.

The known abdominal exercisers for home use are focussed on performing a "sit-up" or "crunch" movement in a consistent manner without contributing any load (adjustable or otherwise) of its own.

It is well established in physiological literature that in order to develop strength, muscles must be progressively loaded so that a maximum of 8 to 20 repetitions are performed.

Exercise machines that achieve this progressive loading are generally only available in a gymnasium because they tend to be large and heavy, often bolted to the floor. A typical device of this type requires the user to be sitting with the weight situated behind and pulled via an overhead pulley wheel into a bent forward (loaded) position (keeping one's back straight). The user then returns to the generally unloaded sitting position and repeats. This type of exercise is most closely related to a "sit-up" rather than "crunch" movement.

These machines are expensive and therefore not accessible to most people, particularly those with an interest in exercising at home.

It should also be noted that, when in a supine position, the initial movement performed in a crunch or sit-up is much more difficult than at the end of the movement. Available machines (as with weights in a gymnasium) apply a constant load. Users are limited by the initial load they must bear but may be capable of bearing greater loads toward the end of the exercise movement.

An exercise movement that has an increasing load as it is performed is thought to be more efficient for strength gains.

SUMMARY OF THE INVENTION

Accordingly, it is a general objective of the present invention to provide an exercise apparatus that, in use, allows a load to be applied to the abdominal muscle groups and is generally portable. The load to be applied should result in a resistance greater than gravity. Furthermore, it is preferable that there be the facility to increase the load, leading to strength gains over time.

In one broad aspect of the present invention there is provided a variable resistance device for an exercise apparatus including at least first and second resilient stages to provide a combined resistance effect, wherein the first resilient stage has a lower coefficient of elasticity than the second resilient stage.

Such a device may be incorporated into a variety of exercise equipment, not necessarily limited to an abdominal exerciser (although this is the primary example described herein). The variable resistance device of the invention has the advantage that it will impart a load to the user that, in the preferred form, is less at the beginning of an exercise movement and then increases toward the end of the movement. In other words the user pulls on the device engaging the first resilient stage and further pulling engages the second resilient stage, providing an increased resistance to the user.

Ideally the variable resistance device also has the ability to be fixed at different resistance values, such that a user may select an appropriate level of resistance at which to exercise. Over time the user will find they should increase the selected level of resistance if strength gains are desired.

In the preferred form the first and second resilient stages are comprised of elastic cords, meaning generally stretchable elements that return to a length at rest. This includes both rubber and "bungee" type cords and coil springs. The term coefficient of elasticity described is therefore intended to cover both elastic materials and elements that exhibit "elastic" features like a coil spring made from metal (which is a material that is not per se elastic, but when coiled acts as if elastic). In general the second resilient stage will be comprised of a thicker cord than the first stage. They may be the same material or not as convenient design dictates.

In its preferred form the first stage includes a non-resilient element (such as a strap) in parallel therewith such that, when the first stage reaches a predetermined maximum extension, the second stage is fully engaged.

It will be appreciated that, in the preferred form, the second stage is always engaged (as the first stage stretches some force must be transferred through to the second stage), but when the first stage reaches a maximum extension held by the parallel strap, all pulling force is then applied to the second stage.

In a second broad aspect of the present invention there is provided an exercise apparatus for abdominal strength training including a base upon which, in use, a user may lie/sit, and a yoke including a handle means, wherein the yoke is connected with a variable resistance device according to the first broad aspect.

Preferably the movement of a user lying on the base is limited between two positions by a stop means, e.g. to the beginning and end of a "crunch" exercise. In one embodiment movement of the yoke is delimited by virtue of a strap or other non-resilient element spanning between the yoke and the base. At the beginning of the movement the yoke and the base are in contact, i.e. user cannot lay further back than the base allows, creating a first limit. At the end of the (crunch) movement the non-resilient element reaches a maximum extension and stops the yoke from moving further.

In a second embodiment the means to limit between two positions includes a stop means associated with either the first resilient stage or a connector (e.g. strap) attached to the yoke is lead through. The stopping function is performed by an abutment fixed to the base coming into contact with a buckle connecting the yoke and the first resilient stage.

In a preferred form the yoke includes a headrest.

According to the invention the resistance as experienced by the user is in two stages, a first (low resistance) stage followed by a second (high resistance) stage. In the preferred embodiment the high resistance stage is variable by way of a resilient loop being placed over successive protruding steps, resistance increasing as the resilient loop pulls further away from the yoke. In a preferred embodiment the protruding steps increase in dimension successively the further away they are positioned from the yoke.

The steps provide a pre-tension to the loop which increases the resistance experienced by the user during the exercise movement (when the second resilient stage kicks in).

In a preferred form the resistance device is housed within or underneath the base, leading to the yoke via a connecter (e.g. a strap) diverting around a diversion means (e.g. a roller) by approximately 90°.

BRIEF DESCRIPTION OF DRAWINGS

Preferred embodiments of the invention will now be described, by way of example only, with reference to the accompanying diagrammatic figures, in which:

FIG. 7 is a general view of an exercise apparatus according to another embodiment of the present invention, FIG. 8 is an underneath general view of the exercise apparatus of FIG. 7.

DETAILED DESCRIPTION OF THE INVENTION

Figure 1:
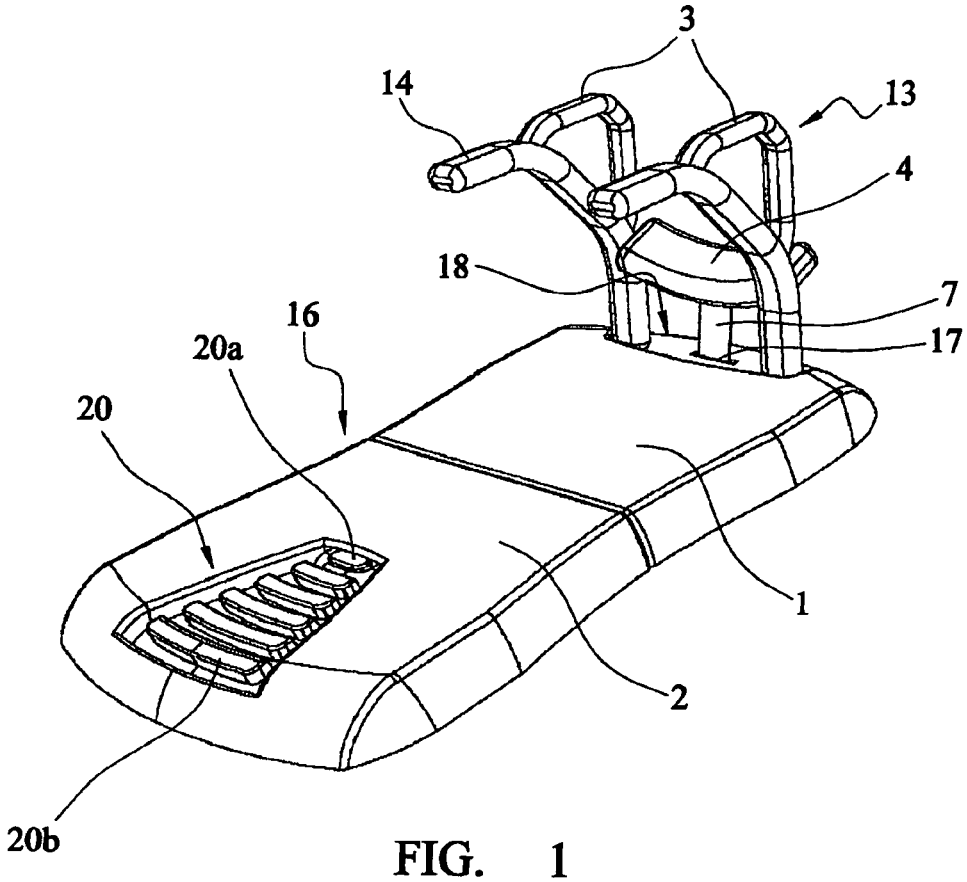
FIG. 1 is a general overview of an exercise apparatus according to one embodiment of the present invention.
Figure 2:
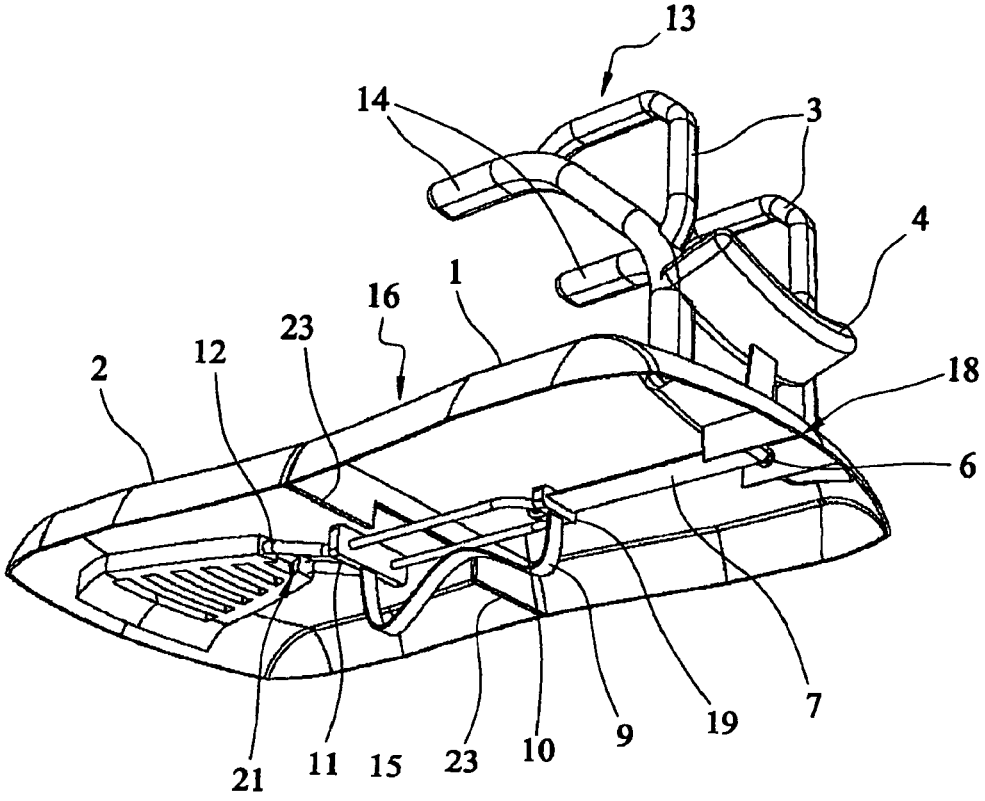
FIG. 2 is an underneath general view of the exercise apparatus.

The general components of an exercise apparatus according to the present invention are illustrated by FIGS. 1 and 2. The apparatus includes a base or "back" board 1, generally broad enough to accommodate the dimensions of an adult human back/shoulders. Back 1 is hingedly attached to a seat 2, of similar dimensions. Back 1 and seat 2 combine to provide a platform 16 upon which a user may lie when in use, as will be described hereinafter.

Extending from one end of the platform 16, from back 1 is a yoke 13 comprising a handle means 3 extending from "over shoulder" arms 14, and a headrest 4. Yoke 13 is connected to a variable resistance device 15 according to the invention on the underside of the platform 16, via a strap 7. Yoke 13 is generally held in place when not in use by tension in the device 15.

Strap 7 leads from headrest 4 through a slot 17 at an upper edge 18 of back 1, around a roller 6 that effectively forms a substantive right angle in the path of strap 7. Strap 7 terminates and is anchored at a first end of the resistance device 15. A coupling buckle or anchor point 19 connects strap 7 with a first resilient stage (low force resistance section) 10 of the device 15. The first stage comprises one or more resilient cords or bands (10) extending to a second anchor point or clamp 11. The distance between buckle 19 and clamp 11 expands/contracts by virtue of the elastic nature of cords 10. In order to limit how far the cords 10 may stretch, a fixed length strap 9, generally longer than the unstretched length of cords 10, joins the buckle 19 and clamp 11. In this way cords 10 are protected from overstretching (that could cause a breakage). In FIG. 2, the apparatus is in a "rest" position so strap 9 is in a loose configuration hanging down from the underside of platform 16.

At a second end of resistance device 15 connected to clamp 11 is a second resilient stage (high force resistance section) comprising a thicker or otherwise stronger cord or band 12 (compared to cords 10).

In the illustrated embodiment, cord 12 is a loop that may be pulled over successive steps or rungs 20 accessible by a user from the topside of platform 16 to enable a further variable load aspect to the invention. From FIG. 2 cord 12 is threaded through apertures 21 in the underside of platform 16 to be visible on the topmost (least resistance) rung 20*a* in FIG. 1.

As illustrated in FIG. 1 each successive rung from 20*a* to an outermost edge rung 20*b* increases in width to form a wedge-shaped appearance. As cord 12 is pulled to a position on a rung away from low resistance section 10, the overall resistance of the second resilient stage increases due to this pre-tensioning. In the illustrated embodiment there are six resistance/load "settings", however, alternative embodiments may have more or less resistance options. It is intended that the materials and tolerances in the preferred embodiment allow a range of resistance up to the equivalent of 30 kg.

It will be apparent that, in operation, as yoke 13 pulls on strap 7 and, in turn to buckle 19 it is the low resistance cord that first stretches until fixed length strap 9 is pulled taught which transfers all pulling force to the high resistance section 12. Operation of the apparatus will now be described by reference to FIGS. 3 and 4.

Figure 3A:
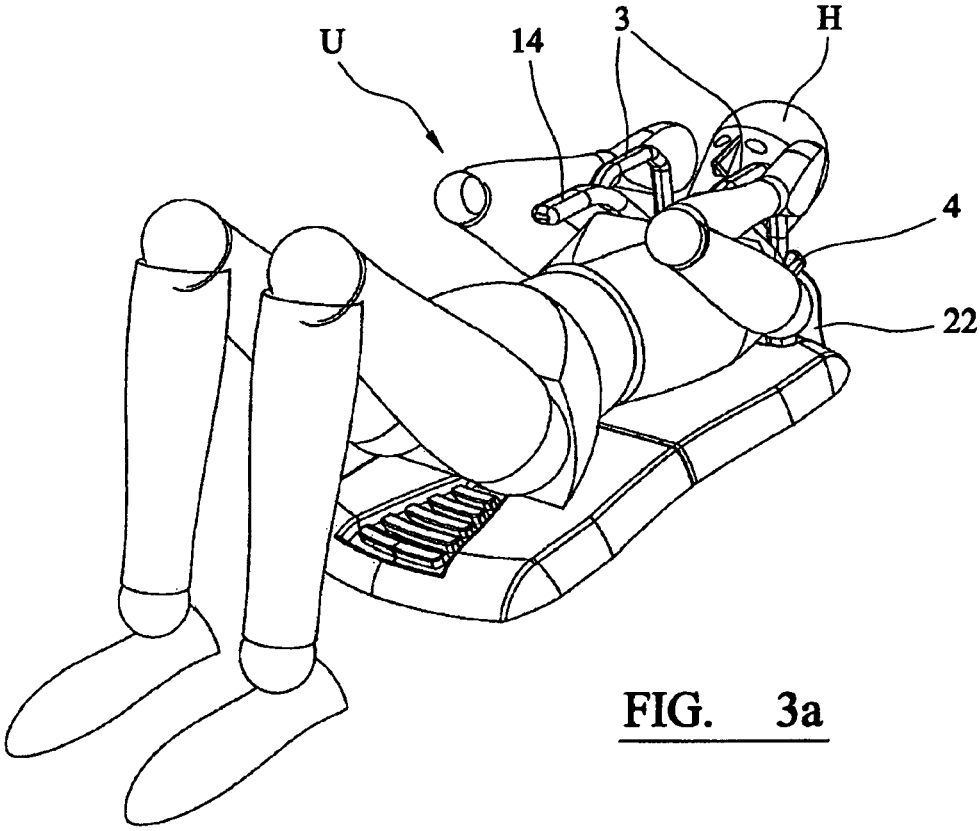
FIGS. 3*a*-3*c* are views showing the exercise apparatus in use at a rest position.

FIG. 3*a* shows a general view of a user U lying in a supine position with knees bent (90° C. or less) and feet flat. Handles 3 are gripped and yoke arms 14 are positioned over the shoulders of a user while the head H (or neck) rests on the headrest 4. No tension is being applied by the user U in FIG. 3 and hence strap 9 can be seen hanging loose underneath platform 16 (FIG. 3*b*). In practice, platform 16 is flat on a floor surface so strap 9 is not visible.

A further limiting strap 22 (that was not shown in FIGS. 1 and 2) is illustrated at the headrest end of platform 16. Strap 22 loosely spans a gap between headrest 4 and the edge 18 of platform 16, e.g. adjacent slot 17. The purpose of strap 22 will become apparent with reference to the crunch movement illustrated by FIG. 4.

Figure 4A:
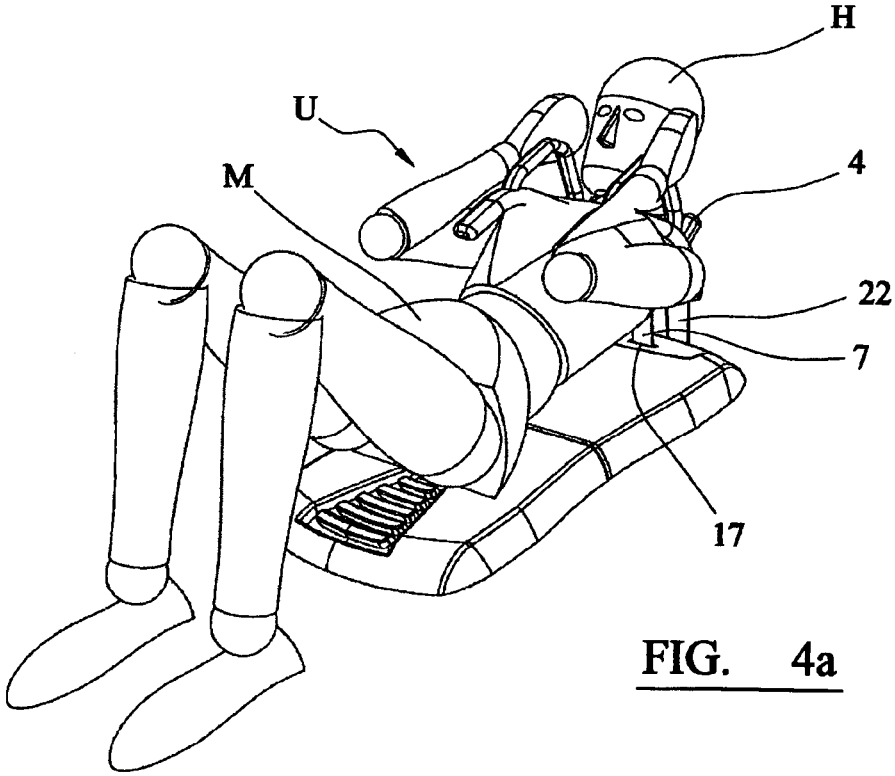
FIGS. 4*a*-4*c* are views that show the exercise apparatus in use at a "crunch" position.
Figure 4C:
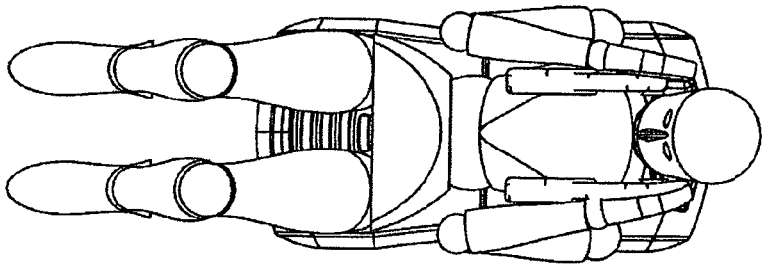
Figure 4B:
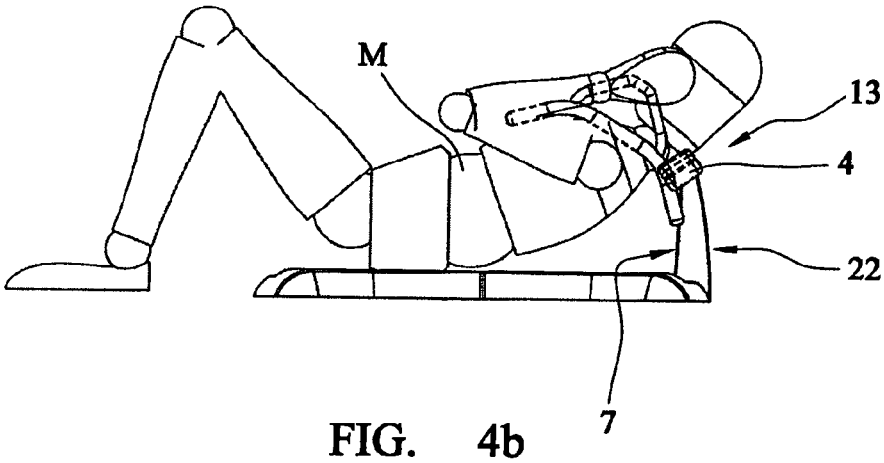

In FIG. 4 user U has performed a resisted crunch movement with the aid of the exercise apparatus of the present invention. Head H has been raised as user U uses strength in the abdominal muscles M to move toward a sitting position. However, user U (in the illustrated embodiment) never reaches a sitting position by virtue of strap 22 that limits the upward movement of yoke 13. This is an isolation feature of the present invention; specifically the user is limited to a crunch only movement as opposed to a full sit up. Removal of strap 22 would allow a full sit up.

As user U raises the head/shoulder, maintaining the buttocks on seat 2, a low resistance is first experienced in muscles M by virtue of first resilient stage 10. As strap 9 reaches its limit, becoming taught, the second resilient stage is directly engaged, i.e. the higher resistance of cord 12 comes into play. Muscles M are more highly loaded until strap 22 becomes taught making further movement impossible.

According to ordinary recommended use, the supine-toward-sitting crunch movement is repeated 8 to 20 times. The last of these repetitions may be to failure. If the resistance provided by the second resilient stage is not sufficient then the next rung 20 can be selected offering higher resistance.

The resistance calculations to determine strength of the elastic cords (or equivalent) preferably encompass a large group of the intended consumer market (e.g. up to the equivalent of 30 kg resistance on a conventional pulley system found in a gymnasium). However, alternative configurations (e.g. considerably stronger cords) can be implemented without modifying the design.

As with other weight training methods (bench press, bicep curls etc.), it is intended that the user will progressively add more resistance over time to improve strength, and not simply aim to perform more and more repetitions.

Figure 5:
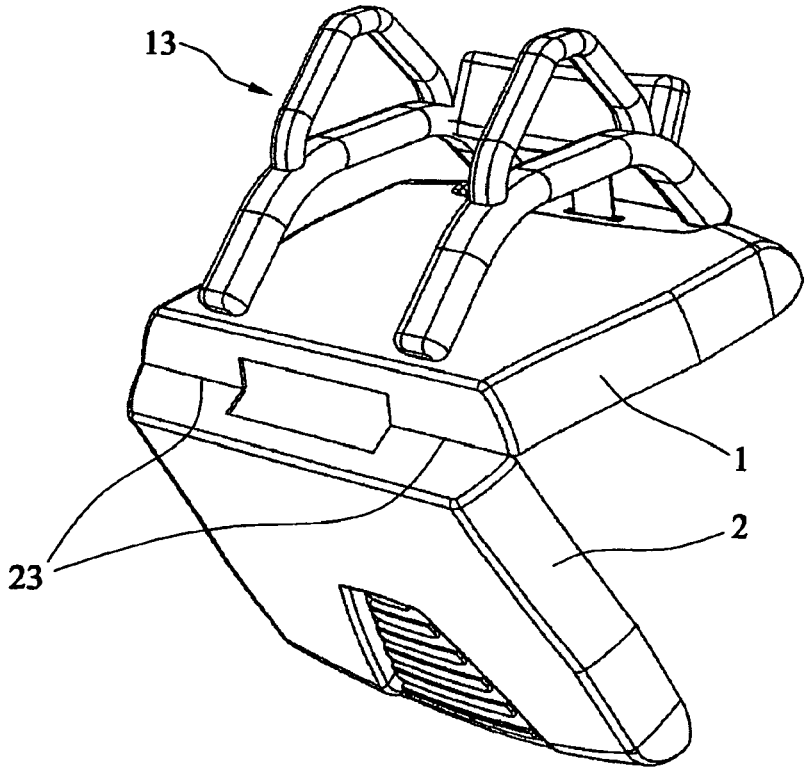
FIG. 5 is a general view of the exercise in a folded position.

FIG. 5 illustrates the apparatus in folded configuration by virtue of a hinge 23. Hinge 23 may be of a suitable form for joining back 1 and seat 2, e.g. a deliberate weakened point in the plastic construction so it will bend, or a conventional hinge construction like in a doorway. Portability by virtue of this collapsible aspect makes the apparatus particularly well suited for home, office or outdoor use.

Figure 3C:
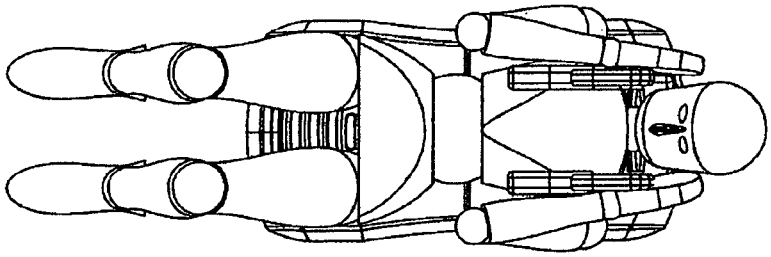
Figure 3B:
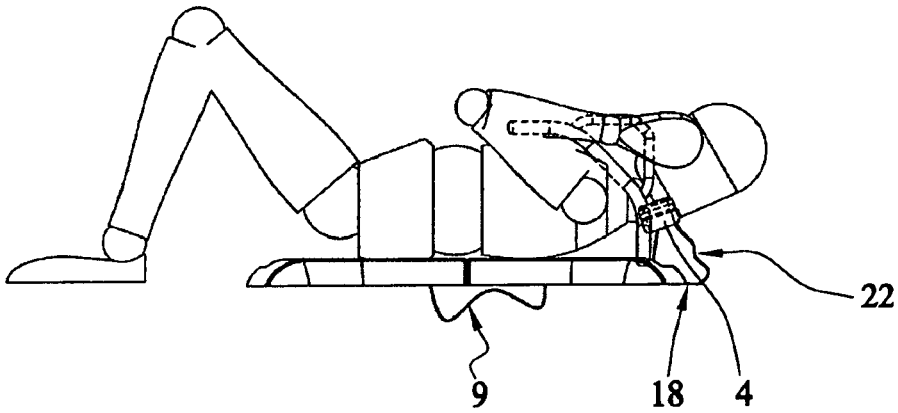
Figure 6:
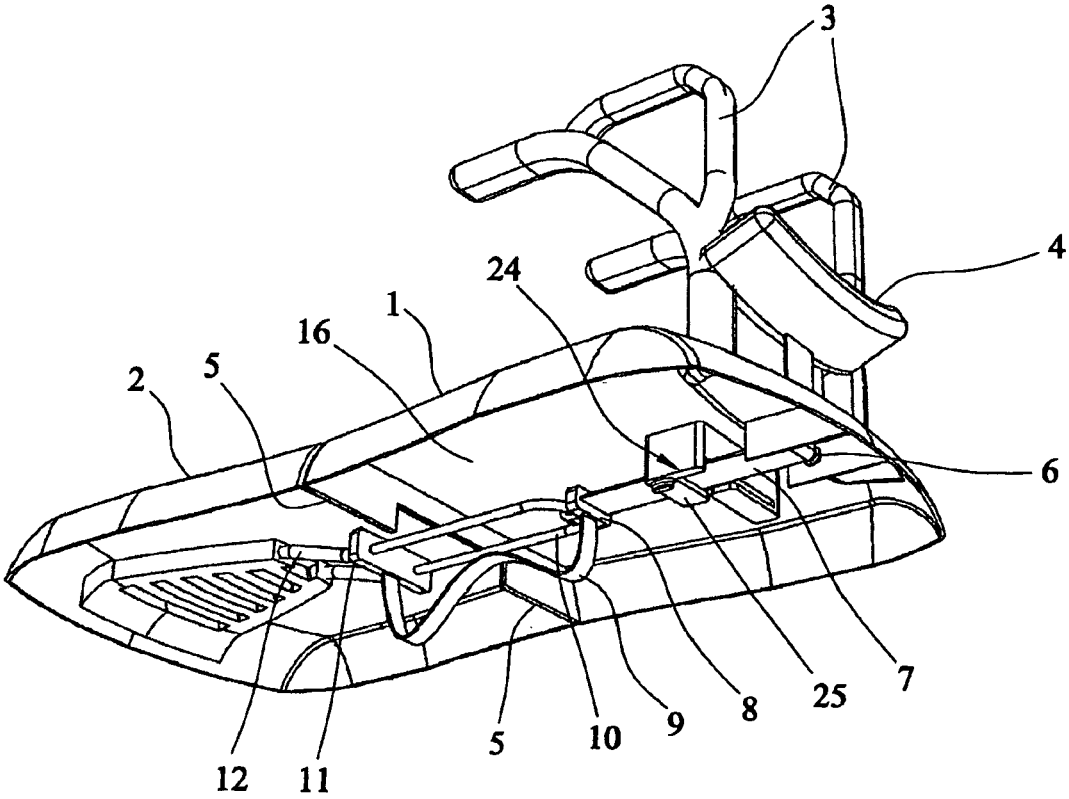
FIG. 6 is a further underneath general view showing an alternative embodiment of a movement limiting means.

FIG. 6 illustrates an alternative embodiment for limiting the upward crunch movement achieved previously by strap 22 in FIGS. 3 and 4. In this embodiment a stop means 24 on the underside of platform 16 is positioned such that strap 7 leads through a slot therein. Stop 24 prevents buckle 19 from moving too far in a direction toward roller 6 thereby limiting the upward crunch movement of user U as they pull on yoke 13. In its preferred form stop 24 will be adjustable so that the crunch movement can be lengthened or shortened depending on the size of person and desired extent of the crunch/sit up. This may be achieved by a slidable element 25, or the entire stop means 24 may be moved relative to platform 16.

The exercise apparatus according to the present invention is preferably designed for safe ergonomic use; hence the seat 2, back 1 and yoke 13 are illustrated with this in mind.

FIGS. 7 and 8 illustrate a further embodiment. Most reference numerals are used in common with the previous Figures. The essential operation of the apparatus remains the same, however, abutment 24 is now a moveable element that is received by recesses 26 in the underside of base 1. In this way abutment 24 can be moved relative to buckle 19 to lengthen or shorten the effective extension of yoke 13 relative to base 1.

Furthermore, in the embodiment of FIGS. 6 and 7 the base 1 is not foldable, but may be carried by a simple handle 27 extending from one side of the base 1.

Figure 9:
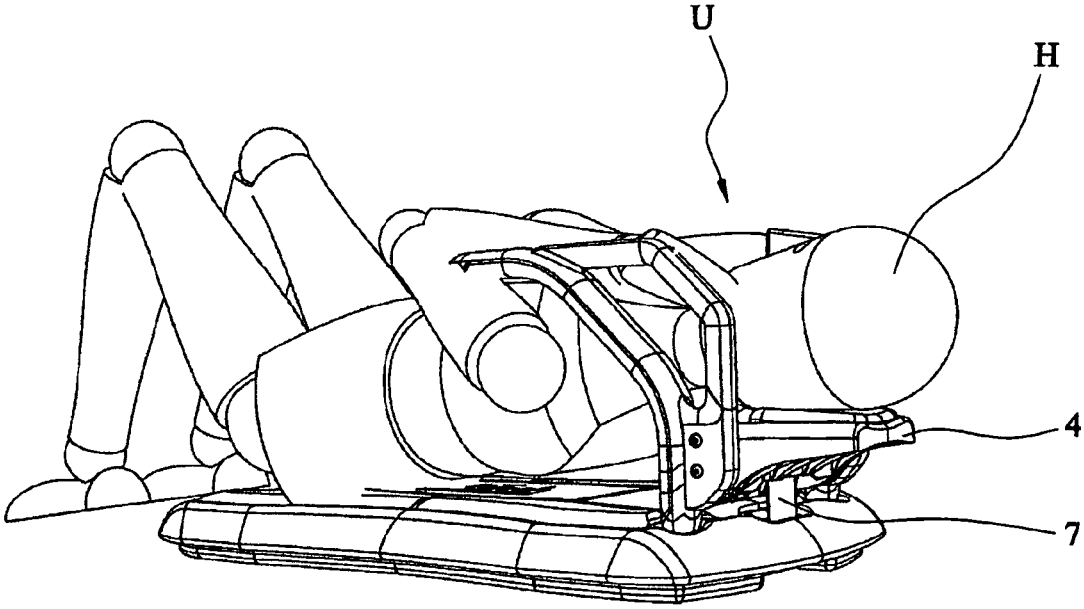
FIG. 9 is a view showing the exercise apparatus in use at rest position, and FIG. 10 a view showing the exercise apparatus in use at "crunch" position.
Figure 10:
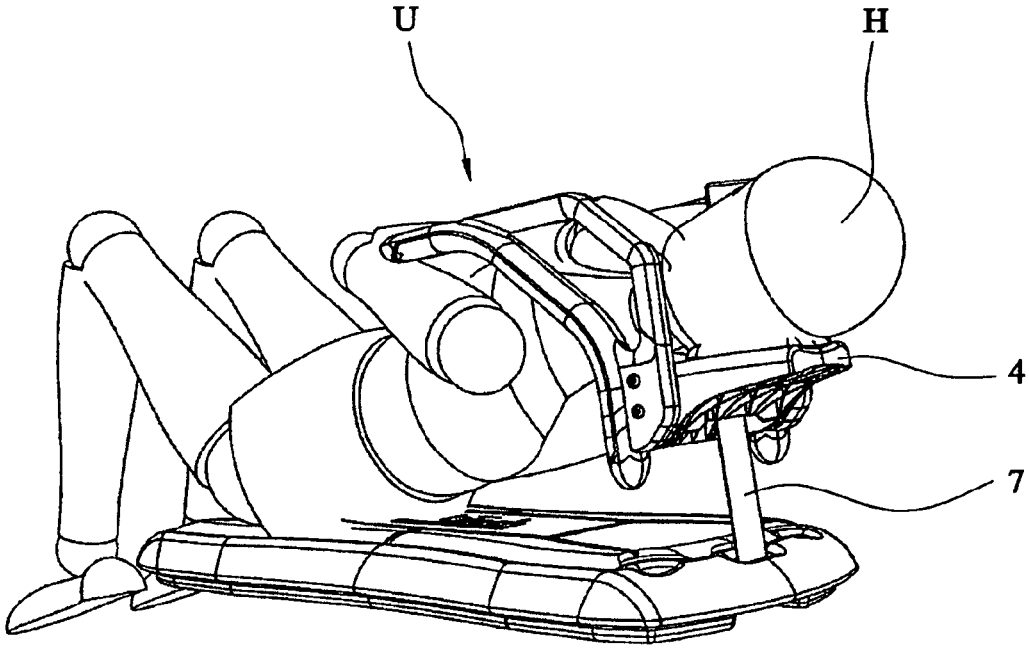

FIGS. 9 and 10 provide a rearward perspective view of a user U upon the embodiment of the invention shown by FIGS. 7 and 8. Operation is equivalent to FIGS. 3 and 4 and strap 7 is clearly visible, limited between a first (FIG. 9) and second (FIG. 10) position defining a crunch movement.

In the illustrated user embodiments the exercise apparatus is shown in a substantially horizontal position, however, it is possible to provide means for incline or decline that will further modify the effect of the resistance mechanism by force of gravity. For example, use of a wedge element placed at either the head or foot end of the apparatus will provide an incline or decline respectively. Such a wedge may raise the apparatus by about 10 to 15 cm.

The exercise apparatus according to the present invention can be made from conventional materials. For example, for home use the platform and yoke components can be manufactured from a high density plastic, whereas gymnasiums may require a more rugged steel construction. Resilient cords 10 and 12 may be made from Santoprene® TPE or other suitable materials. Furthermore, at least cord 10 may be replaced by an equivalent spring or similar resilient component.

The variable resistance aspect of the invention may have embodiments other than that illustrated but still within the scope of the present invention. Advantageously, the present invention allows variable resistance in a home-based abdominal exercise device to increase strength over time and, furthermore, is able to limit movement in the user to strictly a crunch exercise for safety and muscle isolation.

In the illustrated embodiments the first and second resilient stages are shown in series, i.e. connected end to end. However, it would be possible to provide the stages in parallel such that when the first resilient stage reached a predetermined extension, the second resilient stage, beside the first, would be engaged to add to the resistive effect.

What is claimed is:

1. An exercise apparatus for abdominal strength training comprising: a base adapted to accommodate user in a lying or sitting position, said base comprising a series of successive upstanding steps, a yoke comprising a handle, a variable resistance device located within the base and connected to the yoke, said variable resistance device comprising first and second resilient stages to provide a combined resistance effect, the first resilient stage has a lower coefficient of elasticity than the second resilient stage, and the first resilient stage is associated with a non-resilient element arranged in parallel therewith to limit maximum extension thereof, such that when said maximum extension is reached said second resilient stage is fully engaged, wherein the second resilient stage is in the form of a resilient loop that is pulled over said successive upstanding steps to vary the resistance effect of the second resilient stage.

2. The exercise apparatus of claim 1, wherein the yoke further comprises a headrest.

3. The exercise device of claim 1, wherein movement of said yoke relative to said base is limited by a non-resilient element between said base and said yoke.

4. An exercise apparatus for abdominal strength training comprising:

a base adapted to accommodate user lying or sitting position, said base comprising a series of successive upstanding steps, a yoke comprising a handle, a variable resistance device located within the base and connected to the yoke, and said variable resistance device comprising first and second resilient stages to provide a combined resistance effect, the first resilient stage has a lower coefficient of elasticity than the second resilient stage, wherein the second resilient stage is in the form of a resilient loop that is pulled over said successive upstanding steps to vary the resistance effect of the second resilient stage, and wherein movement of said yoke relative to said base is limited by a non-resilient element between said base and said yoke.

5. The exercise device of claim 4, further comprising an abutment and a buckle connecting the yoke to the first resilient stage, so as to limit movement of said yoke relative to said base by a contact between said abutment and said buckle.

6. The exercise device of claim 5, wherein the abutment is adjustable to increase or decrease the distance of limited movement.

7. An exercise apparatus for abdominal strength training comprising:

A base adapted to accommodate user in a lying or sitting position, said base comprising a series of successive upstanding steps, A yoke comprising a handle and a headrest, A variable resistance device located within the base and connected to the yoke, and Said variable resistance device comprising first and second resilient stages to provide a combined resistance effect, the first resilient stage has a lower coefficient of elasticity than the second resilient stage, Wherein the second resilient stage is in the form of a resilient loop that is pulled over said successive upstanding steps to vary the resistance effect of the second resilient stage.

8. The exercise device of claim 7, wherein said successive upstanding steps have varying widths to vary the resistance effect of the second resilient stage as said resilient loop is pulled thereover.

9. The exercise apparatus of claim 8, wherein said successive upstanding steps are located on an upside of the base, so as to be readily accessible to a user, said resilient loop being threaded through from an underside of the base.

* * * * *